US006367964B1

(12) United States Patent
Schmelz et al.

(10) Patent No.: US 6,367,964 B1
(45) Date of Patent: Apr. 9, 2002

(54) HOUSING FOR MICROMIXERS

(75) Inventors: Michael Schmelz, Kriftel; Frank Schwarz, Frankfurt; Jöran Stoldt, Weiterstadt, all of (DE)

(73) Assignee: Merck Patent GmbH, Darmstadt (DE)

( * ) Notice: Subject to any disclaimer, the term of this patent is extended or adjusted under 35 U.S.C. 154(b) by 0 days.

(21) Appl. No.: 09/529,959

(22) PCT Filed: Oct. 12, 1998

(86) PCT No.: PCT/EP98/06463

§ 371 Date: May 26, 2000

§ 102(e) Date: May 26, 2000

(87) PCT Pub. No.: WO99/20382

PCT Pub. Date: Apr. 29, 1999

(30) Foreign Application Priority Data

Oct. 22, 1997 (DE) ..... 197 46 584

(51) Int. Cl.[7] ..... B01F 15/00
(52) U.S. Cl. ..... 366/336; 366/349
(58) Field of Search ..... 366/336–340, 366/349; 24/24, 274 P, 285, 483; 285/364–367, 410, 411

(56) References Cited

U.S. PATENT DOCUMENTS 549,774 A * 11/1895 Forst
576,119 A * 2/1897 Hess
637,068 A * 11/1899 Bang
2,689,141 A * 9/1954 Kiekhaefer
4,573,717 A * 3/1986 Peacock ..... 285/365
4,708,512 A * 11/1987 Allert ..... 24/285
4,739,542 A * 4/1988 Krzesicki ..... 24/285
5,595,712 A * 1/1997 Harbster et al. ..... 366/339
5,653,481 A * 8/1997 Alderman ..... 285/367
5,803,600 A * 9/1998 Schubert et al. ..... 366/337
5,826,977 A * 10/1998 Fowler et al. ..... 366/348
6,082,891 A * 7/2000 Schubert et al. ..... 366/340
6,190,034 B1 * 2/2001 Nielsen et al. ..... 366/336

FOREIGN PATENT DOCUMENTS

| | | |
|---|---|---|
| CH | 409 550 | 10/1966 |
| DE | 39 11 136 | 10/1990 |
| EP | 0 301 180 | 2/1989 |

* cited by examiner

*Primary Examiner*—Charles E. Cooley
(74) *Attorney, Agent, or Firm*—Millen, White, Zelano & Branigan, P.C.

(57) ABSTRACT

A housing for micromixers has two flat circular disk-shaped housing parts situated adjacent to each other in a parting plane. Each of the housing parts has a truncated cone surface on its peripheral edge. A multipart clamping ring which can be tightened in the peripheral direction encompasses the two housing parts and is adjacent to the truncated cone surfaces.

11 Claims, 1 Drawing Sheet

HOUSING FOR MICROMIXERS

FIELD OF THE INVENTION

The invention relates to a housing for micromixer, having two planar housing parts which bear against one another in a parting plane and connecting elements which connect the two housing parts.

BACKGROUND OF THE INVENTION

Various embodiments of micromixers for mixing liquid, viscous or gaseous phases are known. In the embodiment involved here, the mixer housing has two planar housing parts which are pressed against one another in a sealed manner by means of their mutually facing connecting surfaces. To connect such mixer housing parts in a sealed manner, it is known to use a plurality of setscrews which are distributed over the circumference, are fitted through attachment holes in one housing part and screwed into threaded holes in the other housing part or are also fitted through threaded holes in the other housing part and are provided on the rear side of the housing with nuts. This involves relatively high manufacturing outlay. In particular, the time and work involved in the frequently required dismantling and reassembly of the housing parts is relatively high.

SUMMARY OF THE INVENTION

Therefore, the object of the invention is to design a housing for micromixers of the generic type described in the introduction in such a way that it is simple to produce and can be opened and closed in a simple manner with little work and within a short time.

According to the invention, this object is achieved by the fact that the two housing parts are designed substantially in the form of a circular disc and, on their circumferential edge facing away from the parting plane, have a frustoconical surface, and that a multi-part clamping ring, which can be tightened in the circumferential direction, engages around the edges of the two housing parts and bears against the two frustoconical surfaces.

The two frustoconical surfaces form broad, flat chamfers on the outer circumferential edges of the housing parts; the clamping ring which is pressed radially onto these frustoconical surfaces from all sides ensures that the two housing parts are pressed together uniformly, in order to achieve the sealed closure in the parting plane.

To dismantle the housing, it is sufficient to loosen the clamping ring and to take the two housing parts apart. Conversely, assembly takes place in an equally simple way; the two housing parts are fitted onto one another and the clamping ring is placed around them and tightened.

The accurate alignment of the two housing parts with respect to one another can be achieved by centering. Preferably, the two housing parts are centered with respect to one another by means of at least one centering pin.

According to a preferred embodiment of the invention, the clamping ring has two substantially semicircular ring segments which are connected to one another at least at one of their two connection points by a clamping element. The clamping element may be a screw which connects the two ring segments in the circumferential direction. Such a simple mechanical arrangement, which is known, for example as a commercially available small flange joint, is quite sufficient to ensure a high and uniformly distributed pressure on the two parts with respect to one another by means of the wedge effect which is generated at the flat frustoconical surfaces.

Preferably, the two ring segments are articulatedly connected to one another at the connection point which lies opposite the clamping element. As a result, only single clamping element is required for the clamping operation.

BRIEF DESCRIPTION OF THE DRAWING

An exemplary embodiment of the invention is explained in more detail below and is illustrated in the drawing, in which.

DETAILED DESCRIPTION

Figure 1:
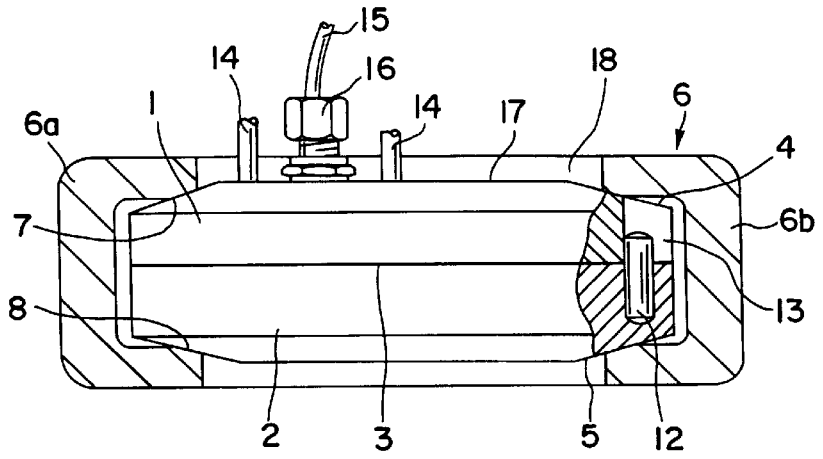
FIG. 1 shows a vertical section through a housing for a micromixer.

Two planar housing parts 1, 2 bear against one another in a parting plane 3. The passages which form the mixing section of the micromixer are accessible in the parting plane 3, for example for a cleaning operation, after the housing parts 1 and 2 have been taken apart.

The two planar housing parts 1 and 2 are designed as circular discs and, on their circumferential edges facing away from the common parting plane, each have a planar frustoconical surface 4 and 5, respectively. A multi-part clamping ring 6 is laid around the assembled housing parts 1 and 2 from the outside. This ring comprises two ring segments 6*a* and 6*b* which are of substantially semicircular design. In cross section, the two ring segments 6*a* and 6*b* are U-shaped and bear against the frustoconical surfaces 4 and 5 of the two housing parts 1 and 2 by means of opposed internal frustoconical surfaces 7 and 8.

Figure 2:
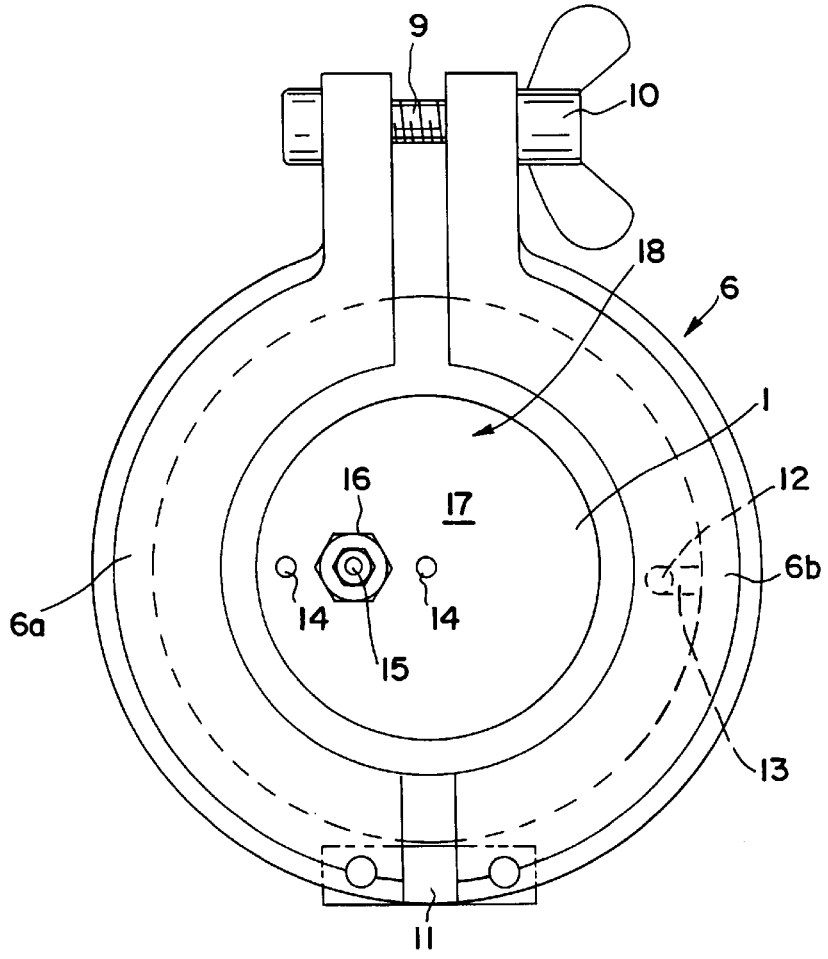
FIG. 2 shows a plan view of the housing in accordance with FIG. 1.

At one of their connection points, in FIG. 2 the connection point at the top, the two ring segments 6*a* and 6*b* are connected to one another by means of a screw 9 which bears a wing nut 10. At the opposite connection point (at the bottom in FIG. 2), the two ring segments 6*a* and 6*b* are articulatedly connected by means of a link 11 which is mounted on the two ring segments 6*a* and 6*b*.

Two centering pins 12, of which only one centering pin 12 is illustrated in the drawing, are fitted into one housing part 2 and project into a matching centering groove 13 in the other housing part 1, in order to center the two housing parts 1 and 2 with respect to one another. When the wing nut 10 is tightened, the two ring segments 6*a* and 6*b* of the clampling ring 6 are drawn together in the circumferential direction, so that they press the two housing parts 1 and 2 against one another with a high pressure under the wedge effect on the planar frustoconical surfaces 7 and 8, thus ensuring a sealed connection.

In the exemplary embodiment illustrated, two metal capillaries 14 are soldered onto an exposed surface 17 of the top housing part 1 to be fixed thereto in order to supply the phases to be mixed to the micromixer and remove the mixture from the mixromixer, which capillaries are provided with a commercially available screw thread at their other end, which is not soldered in. Another line 15 is attached directly to the housing part 1 by means of a conventional screw connection 16. The capillaries 14 and line 15 project into and through the central opening 18 defined by clamping ring 6.

What is claimed is:

1. A housing with a micromixer therein, said housing having two housing parts (1, 2) which bear against one another along a parting plane (3) and having connecting elements which connect the two housing parts (1, 2), the two housing parts (1, 2) each configured as a circular disc with a frustoconical peripheral surface (4 and 5, respectively) facing away from the parting plane (3), and wherein a multi-part clamping ring (6), which is tightenable in the circumferential direction engages around the edges of the two housing parts (1, 2) and bears against the two frustoconical surfaces (4, 5) to hold the two housing parts in abutment at the parting plane (3).

2. The housing according to claim 1, wherein the clamping ring (6) has two substantially semicircular ring segments (6*a*, 6*b*) which are connected to one another at least at one of two connection points by means of a clamping element (9,10).

3. The housing according to claim 2, wherein the clamping element is a screw (10) which connects the two ring segments (6*a*, 6*b*) in the circumferential direction.

4. The housing according to claim 2 wherein the two ring segments (6*a*, 6*b*) are articulately connected to one another (11) at a connection point which lies opposite the clamping element.

5. The housing according to claim 1, wherein the two housing parts (1, 2) are centered with respect to one another by means of at least one centering pin (12).

6. The housing of claim 5 wherein the multipart clamping ring (6) has opposed internal clamping surfaces (7 and 8) which are frustoconical and complement the frustoconical surfaces (4 and 5) of the housing parts (1 and 2) upon engagement therewith.

7. The housing of claim 6 wherein one of said housing parts (1) has metal capillaries (14) fixed with respect to an exposed surface (17) thereof and connected to the micromixer within the housing for supplying phases to mixed to the micromixer and for removing from the micromixer a mixture of the phases.

8. The housing of claim 1 wherein the multipart clamping ring has opposed internal clamping surfaces (7 and 8) which are frustoconical and complement the frustoconical surfaces (4 and 5) of the housing parts (1 and 2) upon engagement therewith.

9. The housing of claim 8 wherein one of said housing parts (1) has metal capillaries (14) fixed with respect to an exposed surface (17) thereof and connected to the micromixer within the housing for supplying phases to mixed to the micromixer and for removing from the micromixer a mixture of the phases.

10. The housing of claim 9 wherein the metal capillaries (14) project into an opening (18) defined by the clamping ring (6).

11. The housing of claim 1 wherein one of said housing parts (1) has metal capillaries (14) fixed with respect to an exposed surface (17) thereof and connected to the micromixer within the housing for supplying phases to mixed in the micromixer and for removing from the micromixer a mixture of the phases.

* * * * *